United States Patent [19]

Nahta

[11] 4,265,704

[45] May 5, 1981

[54] METHOD OF DISPERSING BUNDLES OF GLASS FIBERS FOR MAKING GLASS FIBER MATS BY THE WET-LAID PROCESS

[75] Inventor: Roop C. Nahta, Charlotte, N.C.

[73] Assignee: GAF Corporation, New York, N.Y.

[21] Appl. No.: 25,536

[22] Filed: Mar. 30, 1979

[51] Int. Cl.[3] ..... D21H 5/18

[52] U.S. Cl. ..... 162/156; 162/158

[58] Field of Search ..... 162/152, 156, 157 R, 162/158, 164 R; 260/404.5 ED

[56] References Cited

U.S. PATENT DOCUMENTS

| | | | |
|---|---|---|---|
| 2,681,354 | 6/1954 | Kelley et al. | 260/404.5 ED |
| 3,573,158 | 3/1971 | Pall et al. | 162/156 |
| 3,766,003 | 10/1973 | Schuller et al. | 162/156 |

*Primary Examiner*—Peter Chin

*Attorney, Agent, or Firm*—James Magee, Jr.; Walter Katz

[57] ABSTRACT

What is provided herein is a method of dispersing bundles of glass fibers for making uniform glass fiber mats by the wet-laid process. Well-dispersed glass fiber compositions are prepared herein by agitating chopped bundles of glass fibers in water with a small amount of a surfactant which is a polyethoxylated derivative of the amide condensation product of fatty acids and polyethylenepolyamines. The dispersions are formed at relatively high glass fiber consistencies, and at low surfactant concentrations.

11 Claims, No Drawings

METHOD OF DISPERSING BUNDLES OF GLASS FIBERS FOR MAKING GLASS FIBER MATS BY THE WET-LAID PROCESS

BACKGROUND OF THE INVENTION

1. Field of the Invention

This invention relates to the manufacture of uniform glass fiber mats by the wet-laid process, and more particularly, it is concerned with improved glass fiber dispersion compositions for use in such a process.

2. Description of the Prior Art

High strength, uniform, thin sheets or mats of glass fibers are finding increasing application in the building materials industry, as for example, in asphalt roofing shingles and as backing sheets for vinyl flooring. These glass fiber mats are replacing similar sheets made traditionally of asbestos fibers. Glass fiber mats usually are made commercially by a wet-laid process, which is carried out on modified paper making machinery, as described, for example, in the book by O. A. Battista, *Synthetic Fibers in Papermaking* (Wiley) N.Y. 1964. A number of U.S. patents also provide a rather complete description of the wet-laid process, including U.S. Pat. Nos. 2,906,660; 3,012,929; 3,021,255; 3,050,427; 3,103,461; 3,108,891; 3,228,825; 3,634,054; 3,749,638; 3,760,458; 3,766,003; 3,838,995 and 3,905,067. The German OLS No. 2454354 (Fr. Demande No. 2,250,719), June, 1975, also is pertinent art in this field.

In general, the known wet-laid process for making glass fiber mats comprises first forming an aqueous suspension of short-length glass fibers under agitation in a mixing tank, then feeding the suspension through a moving screen on which the fibers enmesh themselves while the water is separated therefrom. However, unlike natural fibers, such as cellulose or asbestos, glass fibers do not disperse well in water. Actually, when glass fibers, which come as strands or bundles of parallel fibers, are put into water and stirred, they do not form a well-dispersed system. In fact, upon extended agitation, the fibers agglomerate as large clumps which are very difficult to redisperse.

In an attempt to overcome this inherent problem with glass fibers, it has been the practice in the industry to provide suspending aids for the glass fibers, including surfactants, in order to keep the fibers separated from one another in a relatively dispersed state. Such suspending aids usually are materials which increase the viscosity of the medium so that the fibers can suspend themselves in the medium. Some suspending aids actually are surfactants which function by reducing the surface attraction between the fibers. Unfortunately, however, none of the available suspending aids are entirely satisfactory for large volume manufacture of useful, uniform glass fiber mats.

For example, such polymeric suspending aids materials as polyacrylamides, hydroxyethyl cellulose and the like, provide a highly viscous aqueous solution at high material concentrations, which is difficult to handle, and particularly, which drains very slowly through the mat forming screen, or foraminous belt. Furthermore, the degree of the suspension formed using such materials is only fair, and suspensions having a fiber consistency of more than 0.005% give poor quality mats. The viscous suspensions also trap air upon agitation near the formation zone to form stable foams which adversely affect the uniformity and strength of the mats. Finally, the polymers are not effective at low concentrations, and so are expensive for use in what should be a low cost process.

A number of surfactant materials also have been tried for dispersing glass fibers in water, for example, the cationic nitrogen surfactants described in Ger. DT No. 2454354/Fr. Demande No. 2,250,719 (June, 1975). With these surfactants, the glass fiber filaments are drawn from an extruder nozzle, coated with the cationic surfactant, and moistened before chopping into short-length fibers. The chopped fibers then are compounded in another aqueous solution of a cationic surfactant. Accordingly, in this process, the cationic surfactants are applied in two stages to form an aqueous solution and provide acceptable mats at reasonable speeds of mat production. Furthermore, the quality of the dispersions using the materials of this patent application also is poor.

Therefore, it is apparent that for a glass fiber dispersion technique to be effective, it is necessary that the dispersions meet several rigid criteria simultaneously which can provide means for making the desired high quality glass fiber mats at a rapid rate of production in an economically acceptable process. Such criteria are listed below:

1. The dispersing surfactant should provide a uniform dispersion of glass fibers in water effectively at low surfactant concentrations.
2. The dispersions should be efficient at high glass fiber consistencies so that the mats may be formed without having to expend an unnecessarily large amount of energy to separate and handle large quantities of water.
3. The dispersion compositions preferably should not be accompanied by a substantial increase in the viscosity of the medium, which would necessitate extensive pumping equipment at the screen to separate the fibers from the water, and which would make drying of the wet mat difficult.
4. The dispersion compositions should be capable of producing glass fiber mats which have a uniform distribution of fibers characterized by a multidirectional array of fibers. The finished mat product should possess uniform high-strength properties, particularly good tensile strength.
5. The dispersions should be capable of use in the wet-laid process in conventional equipment, at high rates of mat production, without generation of unwanted foams, and without corroding the plant machinery.
6. The surfactant materials preferably should be readily available, at low cost, and be capable of use either by direct addition to the fibers in water, or by precoating the fibers with the surfactant before admixing with water to form the aqueous dispersion composition.

These and other objects and features of the invention will be made apparent from the following more particular description of the invention.

SUMMARY OF THE INVENTION

In accordance with the present invention, there is provided herein improved glass fiber dispersions for making uniform glass fiber mats by the wet-laid process. The well dispersed glass fiber compositions of this invention are prepared by mixing bundles of chopped glass fibers in water with a surfactant which is a polyethoxylated derivative of the reaction product of fatty acids and polyethylenepolyamines. The dispersions are formed at relatively high glass fiber consistencies and at low surfactant concentrations. The resultant dispersions then are used to make very high quality glass fiber mats at high rates of production.

DETAILED DESCRIPTION OF THE INVENTION

The dispersant of the invention is a polyethoxylated derivative of the amide condensation product of fatty acids and polyethylenepolyamines. The preferred dispersant is made by condensing one mole of a mixture of coco and tallow fatty acids with one mole of a mixture of diethylenetriamine and triethylenetetramine, and then ethoxylating the resultant mixed amides with ethylene oxide.

The condensation reaction preferably is run with one mole of a 60/40 molecular mixture of diethylenetriamine and diethylenetetraamine at about 190°-200° C. under pressure of 450 lbs per sq. in. for 5 hours. The ethoxylation reaction is carried out on the resultant mixed amides with about 10-50 moles of ethylene oxides, preferably about 13.5 moles, at a temperature of about 120°-130° C., for a period of about 10 hours, in the presence of an alkaline catalyst, suitably caustic.

The fatty acids may contain from $C_8$-$C_{30}$ carbon atoms, preferably $C_{12}$-$C_{18}$. The final product is sold as "Antarox G-200" by the GAF Corporation, New York, N.Y.

The product contains many discrete molecular species of which the most prominent and functional structures are the following:

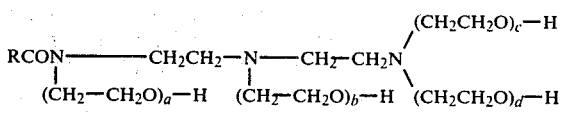

I.

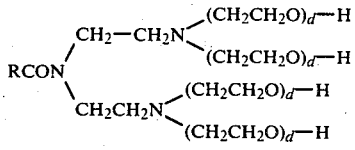

II.

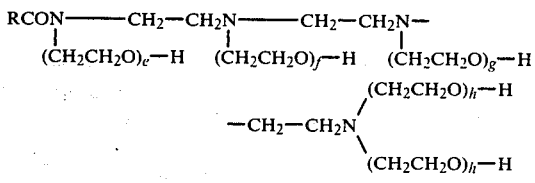

III.

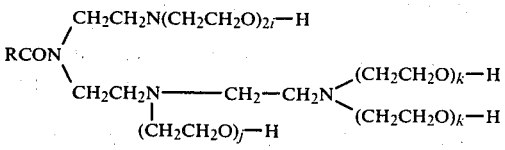

IV.

wherein a through k are positive integers; $\bar{a}$ and $\bar{c}$ can be simultaneously or individually zero; $\bar{b}$, $\bar{f}$, $\bar{g}$ and $\bar{j}$ can be individually, simultaneously or in any combination, zero; $\bar{b}$ cannot be zero unless a is zero; $\bar{f}$ and $\bar{g}$ cannot be zero unless $\bar{e}$ is zero; $200 \geqq \bar{a}+\bar{b}+2\bar{c}+4\bar{d}+\bar{e}+\bar{f}+\bar{g}+2\bar{h}+2\bar{i}+\bar{j}+2\bar{k} \geqq 10$; and R is alkyl, $C_8$-$C_{30}$.

In a typical wet-laid process for making glass fiber mats, a stock suspension of bundles of the fibrous material of predetermined fiber consistency is prepared by vigorous agitation with the dispersant in a mixing tank. The suspension then is pumped into a head box of a papermaking machine where it may be further diluted with water to a lower consistency. The diluted suspension then is distributed over a moving foraminous belt under suction to form a non-woven fiber structure or wet mat on the belt. This wet mat structure may be dried, if necessary, then treated with a binder, and, finally, thoroughly dried to give a finished non-woven mat product.

In the process of the present invention for the production of glass fiber mats, the glass fiber filaments or strands generally are chopped into bundles of fibers about ¼" to 3" in length, usually about ½" to 2", and preferably about 1" long, and usually about 3-20 microns in diameter, preferably about 15 microns. In one embodiment, the fibers are added to water containing the surfactant of the invention to form a well-dispersed composition. Suitably, the dispersant is present at a concentration of about 5-500 ppm of the solution and preferably about 10-25 ppm. Alternatively, the chopped glass fibers may be coated initially by spraying or otherwise applying the surfactant thereon, and then dispersing the coated fibers in the aqueous medium. Suitably, the coated fibers contain about 0.01 to 1% by weight of the dispersant, and, preferably, between 0.025 to 0.25%.

As a feature of the invention, the glass fibers may be dispersed in the surfactant at relatively high fiber consistencies while still retaining the effective dispersion characteristics of the composition. For example, a fiber consistency of from about 0.001% to about 3.0% may be used, and, preferably, about 0.05% to about 1% is employed, based upon the weight of the fibers in the water. Such compositions furnish excellent dispersions when agitated in conventional mixing equipment. As mentioned, if desired, the highly concentrated fiber dispersion compositions may be diluted at the head box, usually to a consistency of about a tenth of the fiber consistency.

The dispersion compositions of the invention are formed without any substantial change in the viscosity of the medium, or of generation of unwanted foams during the process. Furthermore, the dispersions preferably are prepared at or near a neutral pH condition, or perhaps under slightly alkaline conditions, again, without affecting the good quality of the dispersions, or of the finished glass mat products produced therefrom.

The dispersion compositions of the invention produce glass fiber mats which have a high density of fibers therein which are uniformly distributed throughout the mat in a multidirectional array. The finished mats show excellent tensile strength properties, too. The rate of production of the mats is very rapid, indeed, in this invention.

The following examples will more particularly illustrate the invention.

EXAMPLE 1

To 200 ml. of water containing 400 ppm of Antarox G-200 surfactant (100% active, 0.08 g.) was added 1 g. of chopped bundles of E-fiberglass (1" in length, 15 microns in diameter) with vigorous agitation (2500 rpm) for about 20 minutes. An excellent dispersion of the bundles into filaments of the glass fibers was obtained at a resulting fiber consistency of 0.5%. The dispersion thus-formed was made into a glass mat in a laboratory Williams apparatus, dried and cured with a binder. The finished mat product exhibited a uniform distribution and multidirectional array of fibers therein.

EXAMPLE 2

The process of mat formation was carried out as in Example 1 at a 20 ppm concentration of Antarox G-200 dispersant and at a fiber consistency of 0.07%, which was diluted to a formation consistency of 0.02% before mat formation, using E-glass fiber bundles, ½" in length, and 15 microns in diameter. The agitation was carried out in a Lightening mixer at medium speed for about 20 minutes. The dispersion was passed through a mat-forming screen to form an excellent glass mat which was dried and cured as before.

What is claimed is:

1. In the manufacture of uniform glass mats at a high rate of production by the wet-laid process, the improved method which comprises:

forming an aqueous dispersion of glass fibers by mixing bundles of said fibers of about ¼ to 3 inches in length in an aqueous medium at a fiber consistency of about 0.001 to 3% with about 5–500 ppm of a dispersant which is a polyethoxylated derivative of an amide condensation product of fatty acids and polyethylenepolyamines, said product comprises predominately a mixture of the I–IV compounds as defined below:

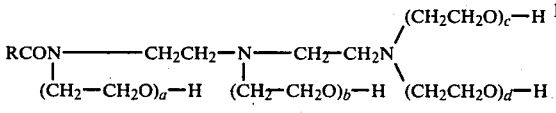

I.

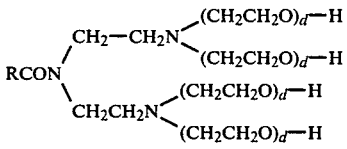

II.

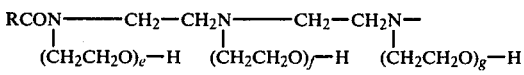

III.

-continued

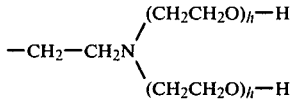

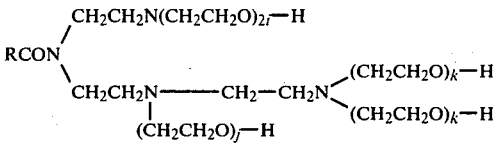

IV.

wherein $\bar{a}$ through $\bar{k}$ are positive integers; $\bar{a}$ and $\bar{e}$ can be simultaneously or individually zero; $\bar{b}$, $\bar{f}$, $\bar{g}$ and $\bar{j}$ can be individually, simultaneously or in any combination, zero; $\bar{b}$ cannot be zero unless $\bar{a}$ is zero; $\bar{f}$ and $\bar{g}$ cannot be zero unless $\bar{e}$ is zero; $200 \geqq \bar{a}+\bar{b}+2\bar{c}+4\bar{d}+\bar{e}+\bar{f}+\bar{g}+2\bar{h}+2\bar{i}+\bar{j}+2\bar{k} \geqq 10$; and R is alkyl, $C_8$–$C_{30}$, thereby to substantially disperse said bundles into individual fibers within the aqueous medium, and, passing said dispersion through a mat-forming screen to form the desired uniform glass fiber mat.

2. A method according to claim 1 wherein in said compounds $\bar{a}+\bar{b}+2\bar{c}+4\bar{d}+\bar{e}+\bar{f}+\bar{g}+2\bar{h}+2\bar{i}+2\bar{h}$ is about 13.5.

3. A method according to claim 1 where in said compounds R is about $C_{12}$–$C_{18}$.

4. A method according to claim 1 wherein said fatty acids are a mixture of coco and tallow fatty acids.

5. A method according to claim 1 wherein said glass fibers are about ½ to 2 inches in length.

6. A method according to claim 1 wherein said glass fibers are about 1 inch in length.

7. A method according to claim 1 wherein said glass fibers are about 3–20 microns in diameter.

8. A method according to claim 1 wherein said glass fibers are about 15 microns in diameter.

9. A method according to claim 1 wherein said glass fiber consistency is about 0.05%.

10. A method according to claim 1 wherein said dispersant is present in a concentration of about 10–25 ppm.

11. A method according to claim 1 wherein said fiber dispersion is diluted before passing through said mat-forming machines.

* * * * *